US006413062B1

(12) United States Patent
Peters

(10) Patent No.: US 6,413,062 B1
(45) Date of Patent: Jul. 2, 2002

(54) PNEUMATIC MOTOR LUBRICATION

(75) Inventor: Dieter Peters, Witten (DE)

(73) Assignee: J. D. Neuhaus GmbH & Co. KG (DE)

( * ) Notice: Subject to any disclaimer, the term of this patent is extended or adjusted under 35 U.S.C. 154(b) by 0 days.

(21) Appl. No.: 09/743,915

(22) PCT Filed: Jul. 15, 1999

(86) PCT No.: PCT/EP99/05022

§ 371 (c)(1),
(2), (4) Date: Jan. 17, 2001

(87) PCT Pub. No.: WO00/04276

PCT Pub. Date: Jan. 27, 2000

(30) Foreign Application Priority Data

Jul. 17, 1998 (DE) ..... 198 32 242

(51) Int. Cl.[7] ..... F03C 2/00

(52) U.S. Cl. ..... 418/99; 418/91; 418/206.8; 418/270

(58) Field of Search ..... 418/91, 99, 270, 418/206.8; 184/6.16

(56) References Cited

U.S. PATENT DOCUMENTS 1,836,249 A * 12/1931 Holmes ..... 418/99
3,261,334 A * 7/1966 Paschke ..... 418/91
3,743,453 A * 7/1973 Abendschein et al. ..... 418/99
3,884,601 A 5/1975 Anthony
3,923,434 A * 12/1975 Walters ..... 418/91
4,134,713 A * 1/1979 Binaut ..... 418/91

FOREIGN PATENT DOCUMENTS

| | | |
|---|---|---|
| GB | 2314886 | 1/1998 |
| JP | 03-096686 | 4/1991 |
| JP | 06-002669 | 1/1994 |

* cited by examiner

*Primary Examiner*—Thomas Denion
*Assistant Examiner*—Theresa Trieu
(74) *Attorney, Agent, or Firm*—Banner & Witcoff, Ltd.

(57) ABSTRACT

The invention relates to a pneumatic motor, in which a rotor (16) driven by compressed air rotates in a cylindrical motor sleeve (14). As a replacement for lubrication with compressed operating air containing oil, as, has hitherto been the conventional practice, cavities (28) for accommodating a lubricant ( ) and connecting paths for the transport of the lubricant (30) from the cavities (28) into the motor sleeve (14) are provided in the rotor (16).

6 Claims, 3 Drawing Sheets

PNEUMATIC MOTOR LUBRICATION

FIELD OF THE INVENTION

The invention relates to a pneumatic motor, in which a rotor driven by compressed air rotates in a cylindrical motor sleeve.

BACKGROUND OF THE INVENTION

An example of such a pneumatic motor is a known vane motor as described, for example, in DE 295 10 799.5. In such a vane motor, a rotor is arranged eccentrically in a cylinder sleeve. Longitudinal slots, in which vanes are accommodated, are located in he rotor body. However, the invention is in no way restricted to vane motors. It can also be applied, for example, to gear motors which are operated with compressed air and in which the rotor consists of a gear pair.

Compressed air fed to the vane motor passes into chambers formed between the vanes. The compressed air drives the motor, so that the rotor starts to rotate in the cylinder. In this case, the vanes may be pressed outwards by springs and with increasing rotary speed under the effect of the centrifugal force, so that they bear against the cylinder in a sealing manner and thus form chambers.

On account of the frictional contact between the vanes and the inner wall of the cylinder, the motor must be lubricated during operation. The conventional method for this purpose provides for oil to be added to the compressed operating air, so that this oil is distributed in the entire motor space and leads to uniform lubrication of the motor.

However, lubrication by compressed air containing oil has proved to be disadvantageous in practice. On the one hand, the oil is transported out of the motor again with the compressed air, a factor which leads to disposal problems. In particular, however, during use under difficult conditions (e.g. in the offshore sector) compressed air enriched with sufficient oil is often not available or the oil reservoirs are not sufficiently refilled.

BRIEF SUMMARY OF THE INVENTION

The object of the present invention is therefore to improve a motor of the said type to the effect that lubrication with compressed operating air containing oil is no longer necessary.

This object is achieved by the present invention. Accordingly, provisions are consequently made for cavities that accommodate a lubricant to be located in the rotor and for these cavities to be connected to the interior space of the cylinder. During operation of the motor, the preferably pasty lubricant accommodated in the cavities inside the rotor is conveyed by the effect of the centrifugal force (during rotation of the rotor) out of the cavities via the connecting paths into the cylinder. In the case of a vane motor, the vanes then provide for the uniform distribution of the lubricant on the inner wall of the cylinder.

In the process, such a quantity of lubricant is preferably fed into the cavities that the motor is sufficiently lubricated for a long time without refilling. In the ideal case, the supply quantity and the outflow quantity, by suitable configuration of the cavities and openings or connecting paths, is selected in such a way that the motor contains a quantity of lubricant which is sufficient for its entire service life.

It is especially advantageous that no additional movable parts are necessary for the lubrication.

In an advantageous development of the invention, the cavities are in each case closed by a porous diaphragm or the like. In this way, accurate metering, which can be predetermined by the type of diaphragm, of the outflow of lubricant is achieved. The lubricant trickles through the porous material only in very small quantities, which, however, are sufficient for the lubrication.

In another development of the invention, provision is made for the cavities to be designed as at least one longitudinal bore in the rotor. Radial bores are likewise possible, but it is simpler with axial bores to keep the outflow quantity of lubricant slight. The longitudinal bores are preferably to be made between two vanes. They may be filled with lubricant over their entire length, so that a sufficiently large reservoir is formed. The porous diaphragm, with which the ends of the bore are in each case preferably closed off, is made, for example, of a porous plastic material of a few millimeters thickness, depending on the size of the rotor.

In a development of the invention, the axial cavities are to be arranged symmetrically around the axis of rotation of the rotor. This is especially advantageous because no unbalance of the rotor develops in a symmetrical arrangement.

According to claim 5, the invention can also be applied to compressed-air-driven gear motors. Radial bores may be expedient in order to lubricate the tooth flanks.

BRIEF DESCRIPTION OF THE DRAWINGS

An exemplary embodiment of the invention is described in more detail below with reference to drawings, in which.

DETAILED DESCRIPTION OF THE INVENTION

Figure 1:
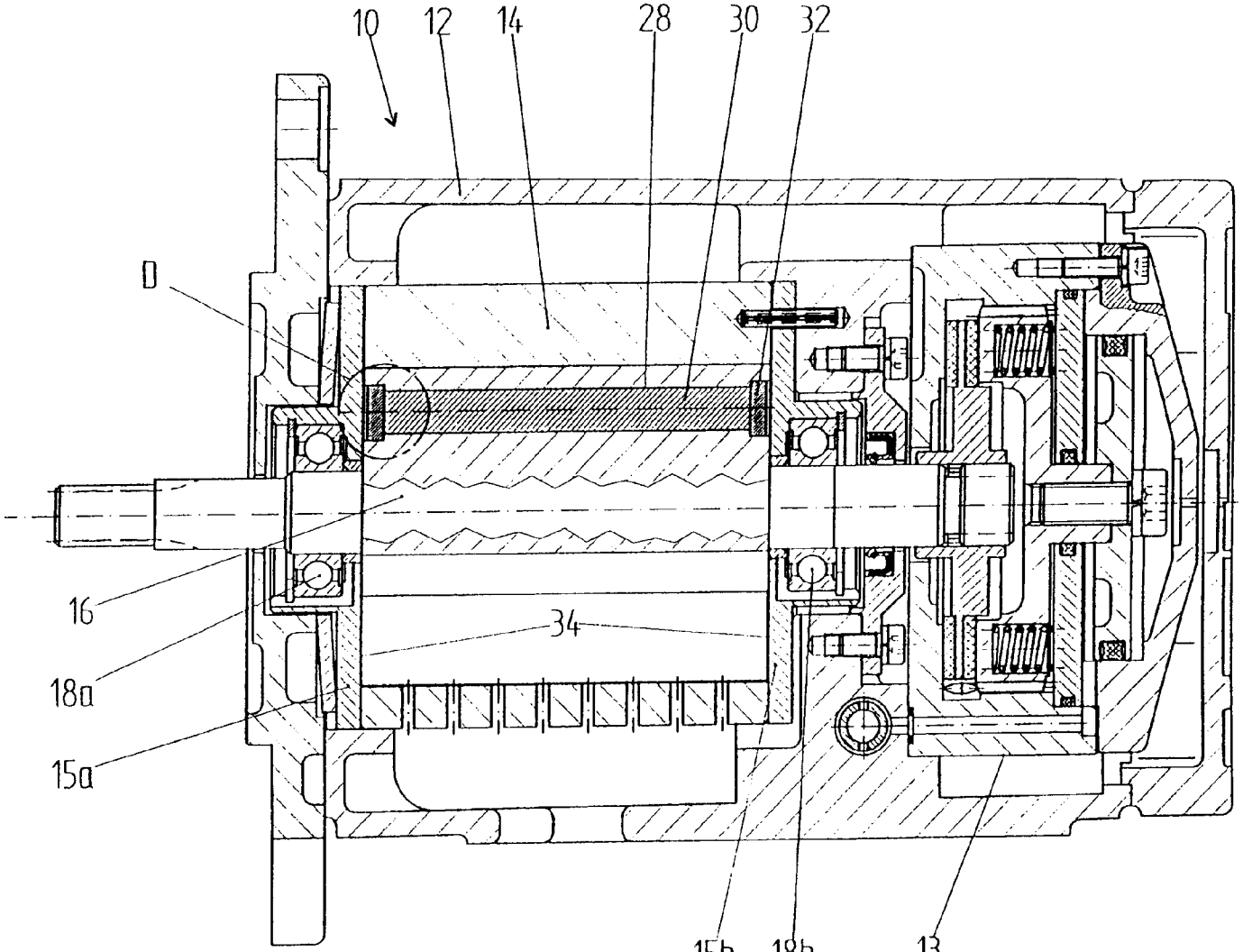
FIG. 1 shows a view of an axial section through a vane motor.
Figure 2:
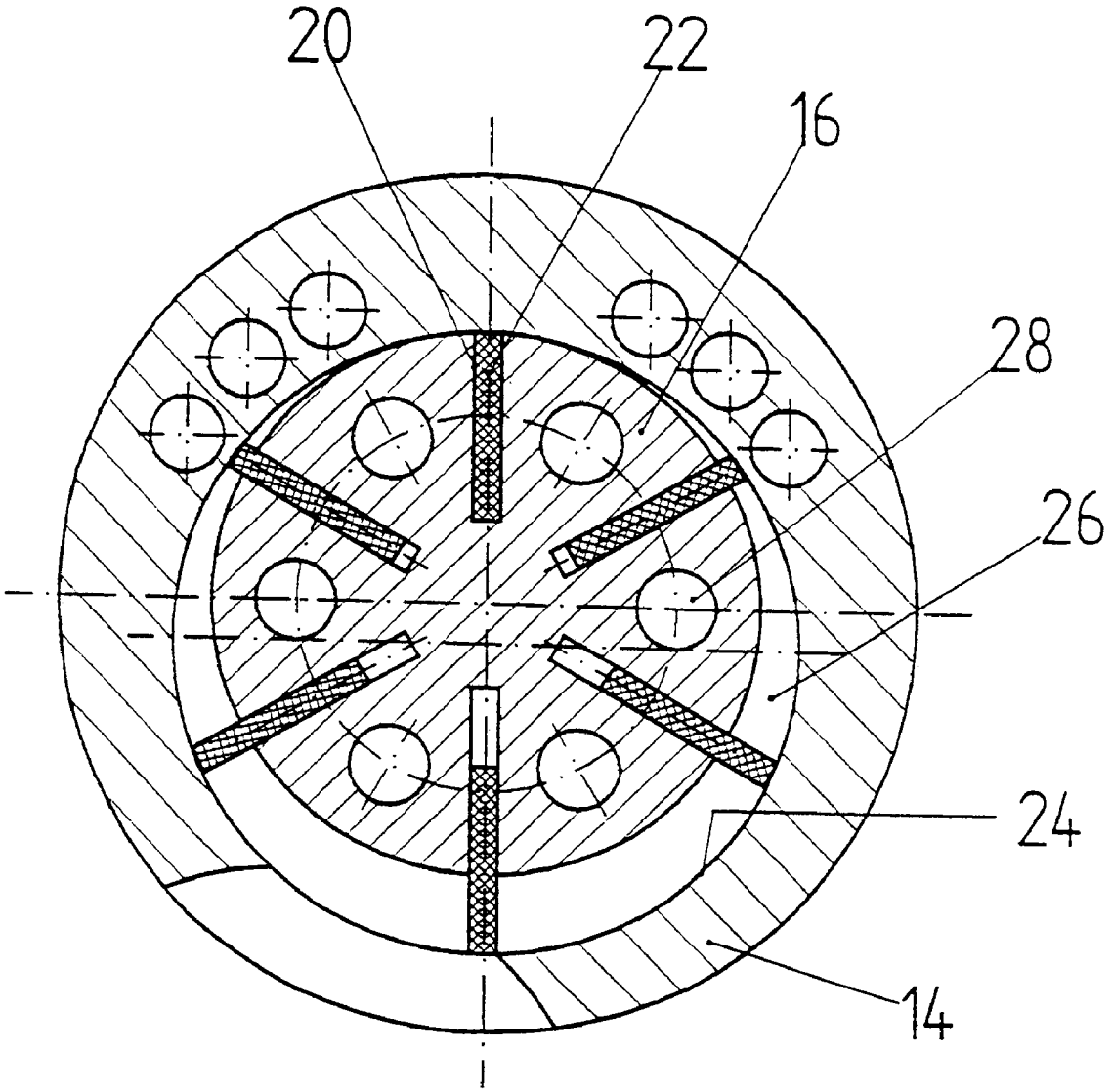
FIG. 2 shows a view of a cross section of a driven rotor in a cylindrical sleeve of a vane motor.

The vane motor 10 shown in FIGS. 1 and 2 has a casing 12, in which a cylindrical motor sleeve 14 is arranged on the right (FIG. 1). A rotor 16 is arranged in the motor sleeve 14. The rotor 16 is mounted in bearings 18*a*, 18*b*. The bearing arrangement of the rotor 16 inside the motor sleeve 14 is eccentric. A brake 13 known per se for braking and arresting the rotor 16 is provided on the left in FIG. 1.

As shown in FIG. 2, the rotor 16 has radial longitudinal slots 20, in which vanes 22 are arranged. The vanes 22 are pressed against the inner wall 24 of the motor sleeve 14 by spring force and during operation under the effect of the centrifugal force. The volume of chambers 26 formed between the vanes 22 changes during rotation of the rotor 16 inside the motor sleeve 14. Compressed air introduced into the chambers 26 expands during the enlargement of the chamber 26 and thus performs work, which drives the rotor 16.

The chambers 26 must be sealed off by pressure of the vanes 22 against the inner surface 24 of the motor sleeve 14. As a result, frictional contact occurs between the vanes 22 and the inner surface 24 of the motor sleeve 14. So that the vanes 22 are not damaged, the motor 10 must be continuously lubricated during operation.

Longitudinal bores 28 are made in the rotor body in a symmetrical pattern around the longitudinal centre axis of the rotor 16. It can be seen in FIG. 2 how a longitudinal bore 28 is made between each two longitudinal slots 20.

As can be seen in FIG. 1, the bores 28 extend over the entire axial length of the rotor 16. A lubricant 30 is embedded in the interior of the bores 28. The lubricant 30 is, for example, a lubricating material containing grease and having a pasty consistency.

Figure 3:
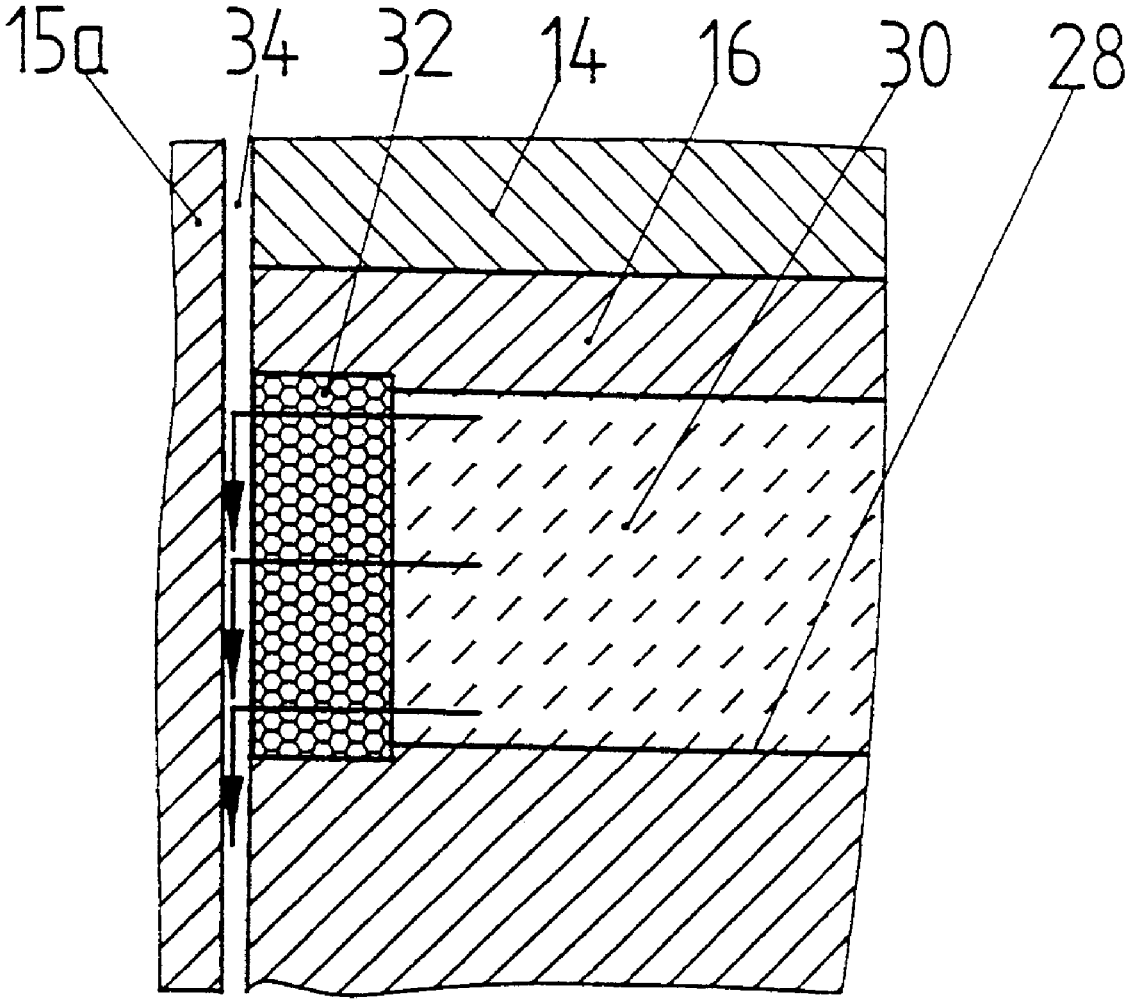
FIG. 3 shows a detail D of the vane motor of FIG. 1.

The bores 28 are closed on both sides of the rotor 16 by porous closures 32, as FIG. 3 also shows. The porous closures 32 are a porous plastic material (e.g. VYON filter material of grade F 4.75 mm (thickness) with an average pore width of 20$\mu$ from Wilhelm Köpp Zellkautschuk, 58515 Lüdenscheid), through which the lubricant 30 flows under pressure (centrifugal force) in very small quantities. A pressure is produced in the lubricant 30 by the centrifugal force, and this pressure is also effective in the axial direction in the longitudinal bores 28. The closures 32 therefore form part of the connecting paths for the transport of the lubricant 30. Corresponding materials are known, for example, from the field of sound attenuation.

The rotor 16 rotates during operation of the vane motor 10. Due to the centrifugal forces acting on the lubricant 30 embedded in the longitudinal bores 28, this lubricant 30 is pressed towards and into the porous closures 32. As a result, the lubricant 30 comes out of the porous closures 32.

Very small gaps 34 (shown exaggerated in FIG. 3) are formed between fixed bearing discs 15*a* and 15*b* respectively in the casing 12 and the end faces of the rotor 16. During movement of the vane motor 10, the lubricant 30 passes outwards through these gaps 34 to the inner surface 24 of the motor sleeve 14, so that the gaps 34 form a further part of the connecting paths for the transport of the lubricant 30. The lubricant 30 is uniformly distributed in the region of the motor sleeve 14 by the movement of the vanes 22. In particular, uniform lubrication of the inner surface 24 is achieved.

In a field test, axial longitudinal bores of 12 mm diameter, in which a closure on both sides by means of a 5 mm long plug of porous plastic material was used, have proved to be advantageous. In such a motor, about 25% of the lubricant (grease) was consumed after an uninterrupted operating period of 100 hours. The lubricant was uniformly distributed in the motor and no failures occurred on account of "dry running" of the vane motor.

What is claimed is:

1. Pneumatic motor comprising: a rotor for being driven by compressed air, a cylindrical motor sleeve in which said rotor rotates, and cavities for accommodating a lubricant, wherein said rotor is provided with connecting paths for the transport of the lubricant from the cavities into the motor sleeve and wherein the cavities form a reservoir for a quantity of lubricant, the reservoir being sealed except for the connecting paths.

2. Pneumatic motor according to claim 1, wherein the cavities are capable of containing a quantity of lubricant sufficient for operation throughout the service life of the motor.

3. Pneumatic motor according to claim 1, wherein the cavities are longitudinal axial bores in the rotor and the connecting paths from the cavities into the motor sleeve include one or more openings of these bores in one or both of the axial end faces of the rotor.

4. Pneumatic motor according to claim 1, wherein the cavities are closed by porous diaphragms or by permeable closures.

5. Pneumatic motor according to claim 1, wherein the pneumatic motor is a vane motor in which the lubricant can be accommodated in at least one of said cavities forming an axial longitudinal bore in the rotor, said axial longitudinal bore being closed on one side or both sides by a porous closure or by a permeable closure.

6. Pneumatic motor according to claim 1, wherein the cavities are arranged symmetrically around the axis of rotation of the rotor.

* * * * *